US008734038B2

(12) United States Patent
Nakamura et al.

(10) Patent No.: US 8,734,038 B2
(45) Date of Patent: May 27, 2014

(54) IMAGE FORMING APPARATUS WHICH GUIDES AN EJECTED RECORDING MEDIUM DOWNWARDS

(75) Inventors: Kazutoshi Nakamura, Nagoya (JP); Takashi Saito, Chiryu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 97 days.

(21) Appl. No.: 13/244,356

(22) Filed: Sep. 24, 2011

(65) Prior Publication Data

US 2012/0114407 A1 May 10, 2012

(30) Foreign Application Priority Data

Nov. 8, 2010 (JP) ..... 2010-249776

(51) Int. Cl.

*B41J 13/10* (2006.01)
*G03G 15/00* (2006.01)
*B65H 29/70* (2006.01)

(52) U.S. Cl.

USPC ..... 400/602; 399/405; 271/220

(58) Field of Classification Search

CPC ..... B41J 13/10; B41J 13/106; B41J 11/0045; G03G 15/6552; G03G 15/6576; G03G 2215/00421; B65H 29/22; B65H 29/52; B65H 29/70

USPC ..... 399/405, 406; 271/207, 220; 400/602

See application file for complete search history.

(56) References Cited

U.S. PATENT DOCUMENTS 6,722,646 B2 * 4/2004 Sekiyama et al. ..... 270/58.09
6,722,651 B2 4/2004 Fujisawa et al.
7,962,061 B2 * 6/2011 Sato et al. ..... 399/107
2002/0038936 A1 4/2002 Fujisawa et al.
2006/0239735 A1 10/2006 Ogata et al.
2009/0146369 A1 * 6/2009 Yoshimura et al. ..... 271/207
2009/0214279 A1 8/2009 Ito
2009/0245906 A1 10/2009 Jeong et al.
2010/0171256 A1 7/2010 Ogata et al.

FOREIGN PATENT DOCUMENTS

CN 1854047 A 11/2006
CN 101551607 A 10/2009
JP 4-112853 U 10/1992
JP 5-043115 A 2/1993

(Continued)

OTHER PUBLICATIONS

JP Office Action dtd Jan. 29, 2013, JP Appln. 2010-249776, English translation.

(Continued)

*Primary Examiner* — Daniel J Colilla
*Assistant Examiner* — Blake A Tankersley
(74) *Attorney, Agent, or Firm* — Banner & Witcoff, Ltd.

(57) ABSTRACT

An image forming apparatus is provided that includes an image forming unit disposed in a main body and configured to form an image on a recording medium, an output tray provided in the main body and configured to receive the recording medium having an image formed thereon, and an ejection device provided in the main body and configured to eject the recording medium to the output tray. The apparatus may further include a movable sheet guiding member movably attached to the main body and a stationary sheet guiding member disposed downstream of the movable sheet guiding member in a recording medium ejection direction and above the output tray. The movable sheet guiding member can press a recording medium ejected from the ejection device downward, and the stationary sheet guiding member can protrude from the main body.

15 Claims, 9 Drawing Sheets

(56) References Cited

FOREIGN PATENT DOCUMENTS

| | | | |
|---|---|---|---|
| JP | 2002-114423 | A | 4/2002 |
| JP | 2005-132559 | A | 5/2005 |
| JP | 2009-202965 | A | 9/2009 |

OTHER PUBLICATIONS

Notification of First Office Action with Search Report in related Chinese Patent Application No. 201110296737.9 mailed Dec. 6, 2013.

* cited by examiner 25D
27C
27D
13
(13B)
25
20
11
27B
11A
27
OVERLAP
A
REAR
RIGHT
LEFT
FRONT 11
11A
27B
25C
25B
25C
11A
20
25
27A
13(13A)
27
TOP
REAR
RIGHT
LEFT
FRONT
BOTTOM

IMAGE FORMING APPARATUS WHICH GUIDES AN EJECTED RECORDING MEDIUM DOWNWARDS

CROSS REFERENCE TO RELATED APPLICATION

This application claims priority from Japanese Patent Application No. 2010-249776, filed on Nov. 8, 2010, the entire subject matter of which is incorporated herein by reference.

FIELD

Aspects of the invention relate to an image forming apparatus.

BACKGROUND

A known image forming apparatus may include a sheet guiding member in proximity to an ejection roller to ensure that each recording medium, e.g., a sheet of paper, on which an image has been formed, is stacked on an output tray.

An upper end of the sheet guiding member is attached to a main body of the image forming apparatus so that the sheet guiding member is movable. The sheet guiding member is configured to press an ejected recording sheet having an image thereon using the weight of the sheet guiding member. If a recording sheet having great bending stiffness gets curled, the sheet may raise the sheet guiding member, which may be unable to function normally.

This problem can be solved by increasing the weight of the sheet guiding member. However, if a recording sheet having small bending stiffness hits the sheet guiding member when it is ejected, the recording sheet may buckle and become jammed.

SUMMARY

Illustrative aspects of the invention provide an image forming apparatus configured to stably eject a recording sheet regardless of its bending stiffness.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. Aspects of the invention are applied to an image forming apparatus 1 combining a monochrome laser printer and an image reading mechanism together.

A first illustrative embodiment of the invention will be described.

Figure 1:
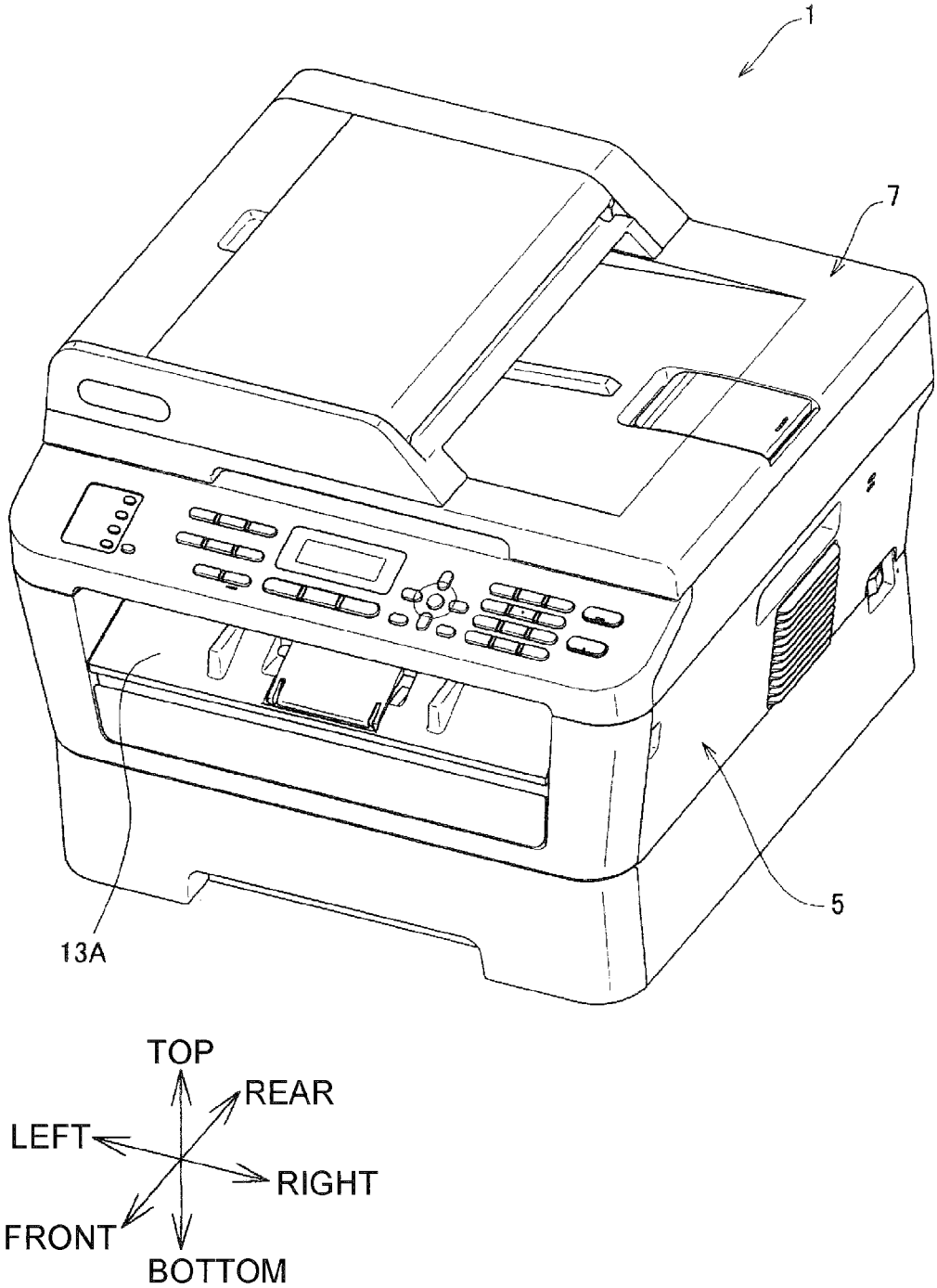
FIG. 1 is a perspective view of an outer appearance of an illustrative example of an image forming apparatus according to a first embodiment of the invention.

As shown in FIG. 1, the image forming apparatus 1 may include an image forming mechanism 5 and an image reading mechanism 7 disposed above the image forming mechanism 5.

The image forming mechanism 5 includes an image forming unit 3 (see FIG. 2) that is configured to form an image on a recording medium, e.g., a sheet of plain paper, a transparency, etc., (hereinafter referred to as a sheet P).

Figure 2:
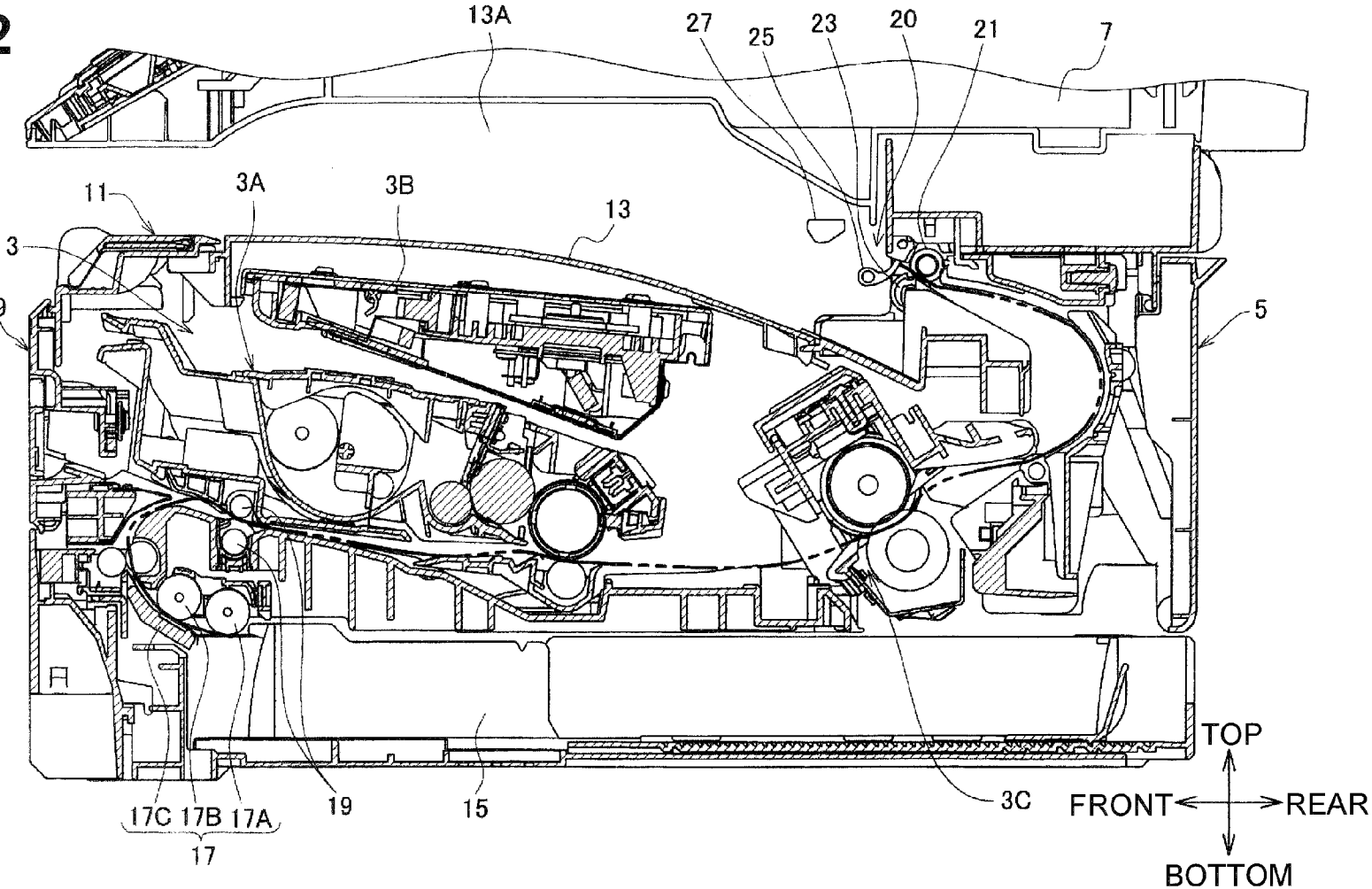
FIG. 2 is a sectional view of an illustrative image forming mechanism.

As shown in FIG. 2, a sheet P on which an image has been formed at the image forming unit 3 is ejected and received onto an output tray 13 provided on an upper surface of a main body, in this example, a casing 9 of the image forming mechanism 5 (hereinafter the upper surface of the casing 9 is referred to as a joint cover 11).

An ejected sheet accommodating space 13A to which a sheet P having an image thereon is ejected and accommodated is provided between the output tray 13 and the image reading mechanism 7. The image reading mechanism 7 is coupled to the joint cover 11 across the ejected sheet accommodating space 13A from above.

In this illustrative embodiment, the joint cover 11 is detachably attached to the casing 9. The joint cover 11 and the casing 9 may be made of resin such as acrylonitrile butadiene styrene (ABS).

The image forming unit 3 is of electrophotographic type and in this example includes a process cartridge 3A, a light exposing device 3B, and a fixing unit 3C.

A sheet supply tray 15 may be disposed in a lower portion of the casing 9 and configured to have a stack of sheets P loaded therein. A feeder unit 17 is disposed at the front side of the sheet supply tray 15. The feeder unit 17 includes a pick up roller 17A, a separation roller 17B, and a separation pad 17C. A sheet P is separated from the stack of sheets P by the feeder unit 17, and may be fed between a pair of registration rollers 19 to correct skew of the sheet P, and is further fed to the process cartridge 3A.

A developer image is transferred onto the sheet P at the process cartridge 3A, and heated and fixed at the fixing unit 3C. The sheet P, which is fed from the fixing unit 3C, changes its feeding direction upward about 180 degrees, and is ejected from an ejection portion 20, which opens to the output tray 13.

As shown in FIGS. 2-7 (in particular FIG. 7), ejection rollers 21, pinch rollers 23, and movable sheet guiding members 25, and stationary sheet guiding member 27 may be arranged in the ejection portion 20 of the output tray 13. The ejection rollers 21 and the pinch rollers 23 together are an example of and function as an ejection device.

The ejection rollers 21 are configured to rotate in contact with a sheet P received from the image forming unit 3 and to eject the sheet P to the output tray 13. At least cylindrical portions of the ejection rollers 21 that contact the sheet P may be formed of an elastic material such as rubber.

A plurality of, e.g., four in this illustrative embodiment, ejection rollers 21 is disposed in spaced relation to each other in a width direction of the ejection portion 20. The ejection rollers 21 are driven by a drive shaft 21A that is rotatably coupled to the casing 9 of the image forming mechanism 5.

The width direction refers to a direction perpendicular to a sheet ejection direction D1 (see FIG. 7) where a sheet P is ejected from the ejection rollers 21 and the pinch roller 23 of the ejection portion 20 and a thickness direction of a sheet P. In this illustrative embodiment, the width direction coincides with a left-right direction of the image forming apparatus 1 (or the image forming mechanism 5). In this illustrative embodiment, the sheet ejection direction D1 is substantially parallel with a tangent direction at a nip point P1 described later.

The pinch rollers 23 may be disposed in positions facing the ejection rollers 21, one by one, from below. The pinch rollers 23 are cylindrically shaped, and are configured to press the sheet P toward the ejection rollers 21. The pinch rollers 23 are movably attached to the casing 9 of the image forming mechanism 5 such that they move toward and away from the ejection rollers 21.

Thus, while absorbing a change in thickness of a sheet P, the ejection rollers 21 and the pinch rollers 23 contact a sheet P ejected from the fixing unit 3C by sandwiching it from both front and back sides, and feed the sheet P having an image toward the ejection tray 13.

Figure 8A:
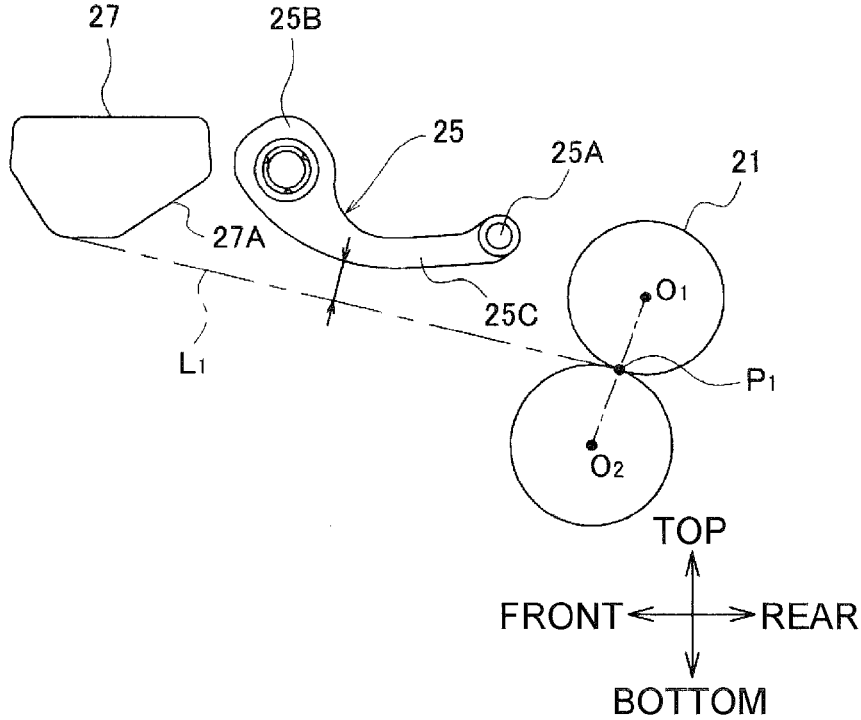
FIGS. 8A and 8B illustrate positional relationship between a nip portion, the movable sheet guiding member, and the stationary sheet guiding member.

As shown in FIG. 8A, hereinafter, a contact point among the ejection roller 21, the pinch roller 23 and the sheet P is called as a nip point P1 where the sheet P is nipped between the ejection roller 21 and the pinch roller 23. As the cylindrical portion of the ejection roller 21 is formed of an elastic material such as rubber, the precise position of the actual nip point P1 may vary within a small range of locations. However, for easy understanding, a contact point between a circle representing a peripheral surface of the ejection roller 21 and a circle indicating a peripheral surface of the pinch roller 23 is represented as the nip point P1 in FIGS. 8A and 8B.

Figures 6A, 6B:
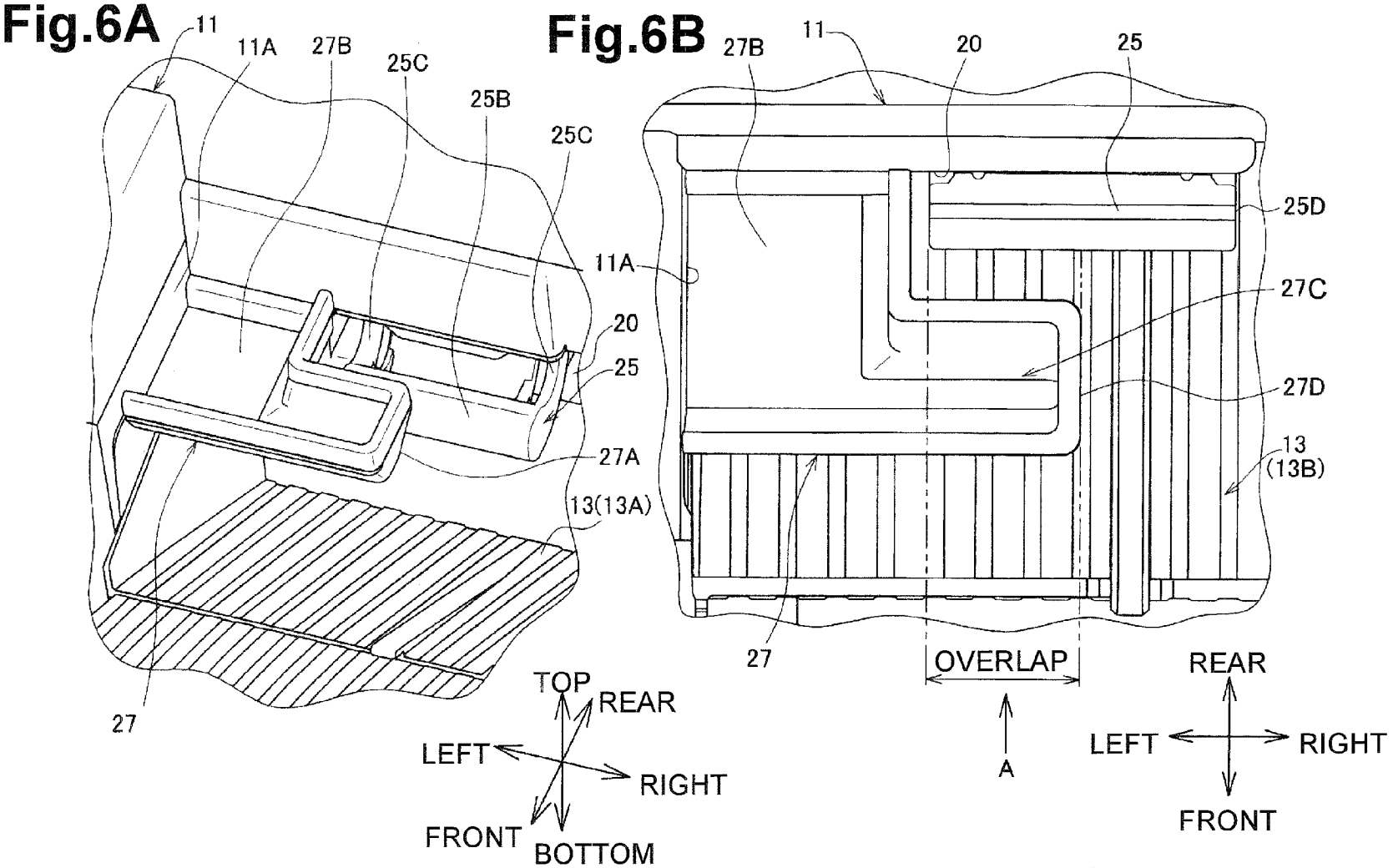
FIG. 6A is a perspective view of an illustrative stationary sheet guiding member and an illustrative movable sheet guiding member.
FIG. 6B is a top view of the stationary sheet guiding member.
Figure 7:
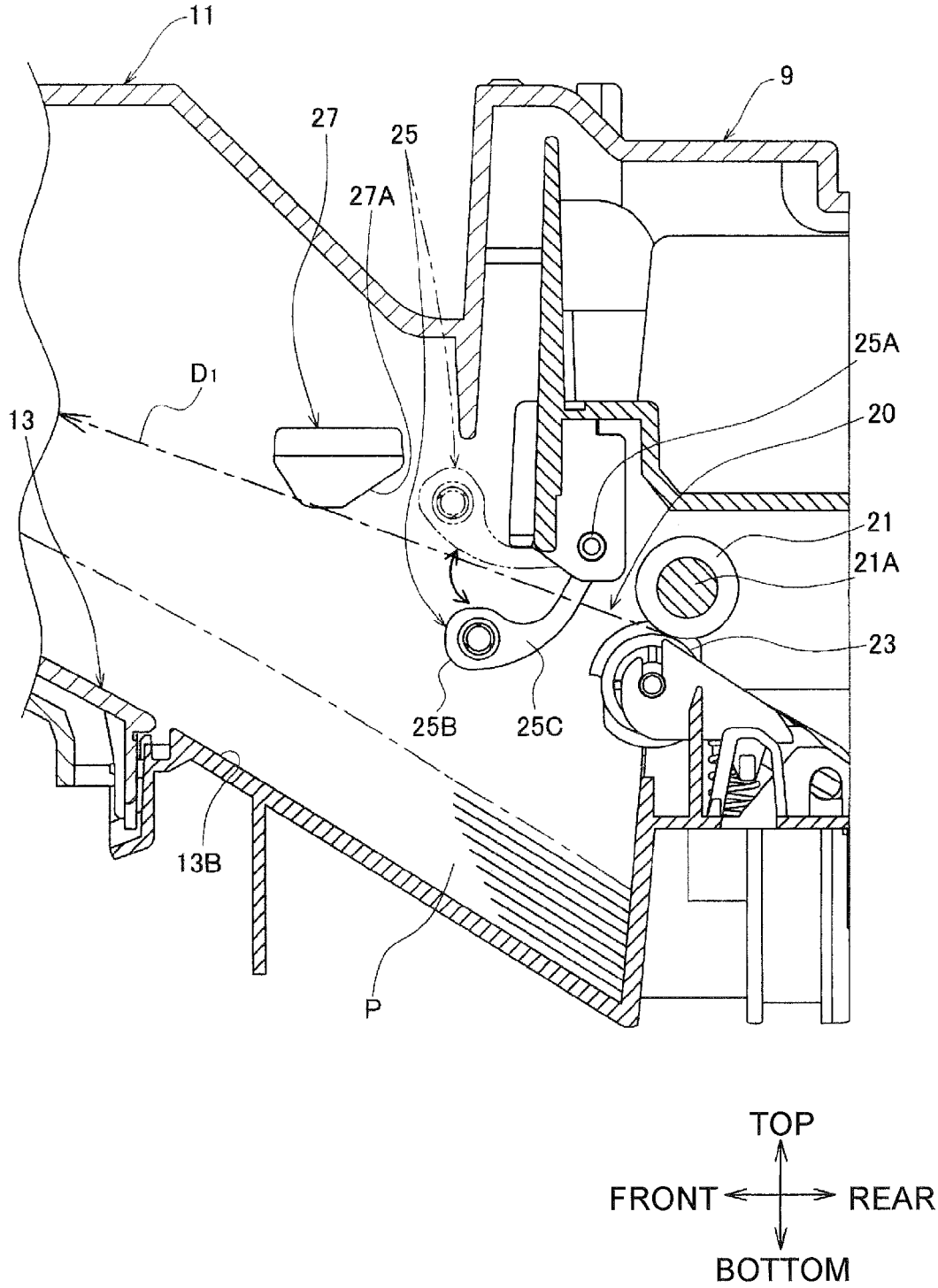
FIG. 7 is a sectional view of an ejection portion of the image forming apparatus.

As shown in FIG. 6A, the movable sheet guiding member 25 is exposed from the ejection portion 20 to the output tray 13 and configured to press the sheet P ejected from the ejection rollers 21 downward. As shown in FIG. 7, a shaft portion 25A, which is provided at an upper portion of the movable sheet guiding member 25, is coupled to the joint cover 11 so that the movable sheet guiding member 25 is movable.

Figure 3:
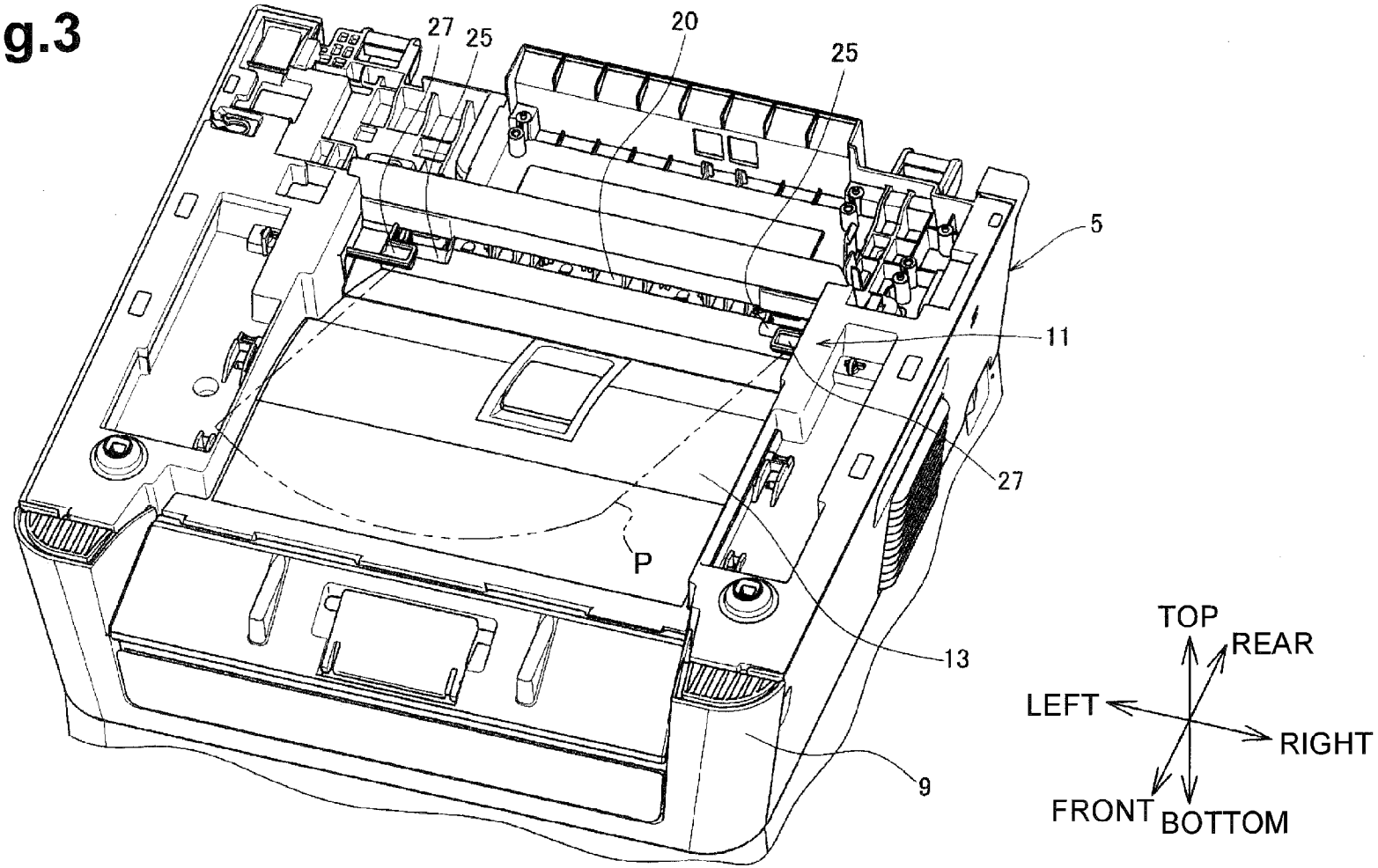
FIG. 3 is a perspective view of the image forming mechanism of the image forming apparatus from which an image reading mechanism is removed, as viewed from above.

As shown in FIG. 3, the movable sheet guiding members 25 are disposed in positions corresponding to both sides of the ejection portion 20 extending in the width direction (the left-right direction). As shown in FIG. 6A, each movable sheet guiding member 25 includes a weight portion 25B and arm portions 25C. The weight portion 25B extends in the width direction, and is configured to contact the sheet P being ejected by the ejection rollers 21 and press it downward. The arm portions 25C extend from both sides of the weight portion 25B, in a direction perpendicular to the width direction and opposite the sheet ejection direction, toward a pivot center of the movable sheet guiding member 25. Each arm portion 25C includes the shaft portions 25A (see FIG. 7) at its end.

The shaft portions 25A rotatably engage in recessed portions (not shown) of the joint cover 11, so as to movably support the movable sheet guiding member 25. As shown in FIG. 8A, the shaft portions 25A are disposed on a downstream side of the nip point P1 in the sheet ejection direction D1, and above the nip point P1. Thus, when the sheet P is ejected from the ejection portion 20 toward the output tray 13, the movable sheet guiding member 25 presses the sheet P downward using the weight of the weight portion 25B.

As shown in FIG. 7, the stationary sheet guiding member 27 is disposed on a downstream side of the movable sheet guiding member 25 in the sheet ejection direction D1, and on a wall surface 11A (see FIG. 6B) extending upward from each side of a sheet receiving surface 13B in the width direction.

Figure 4:
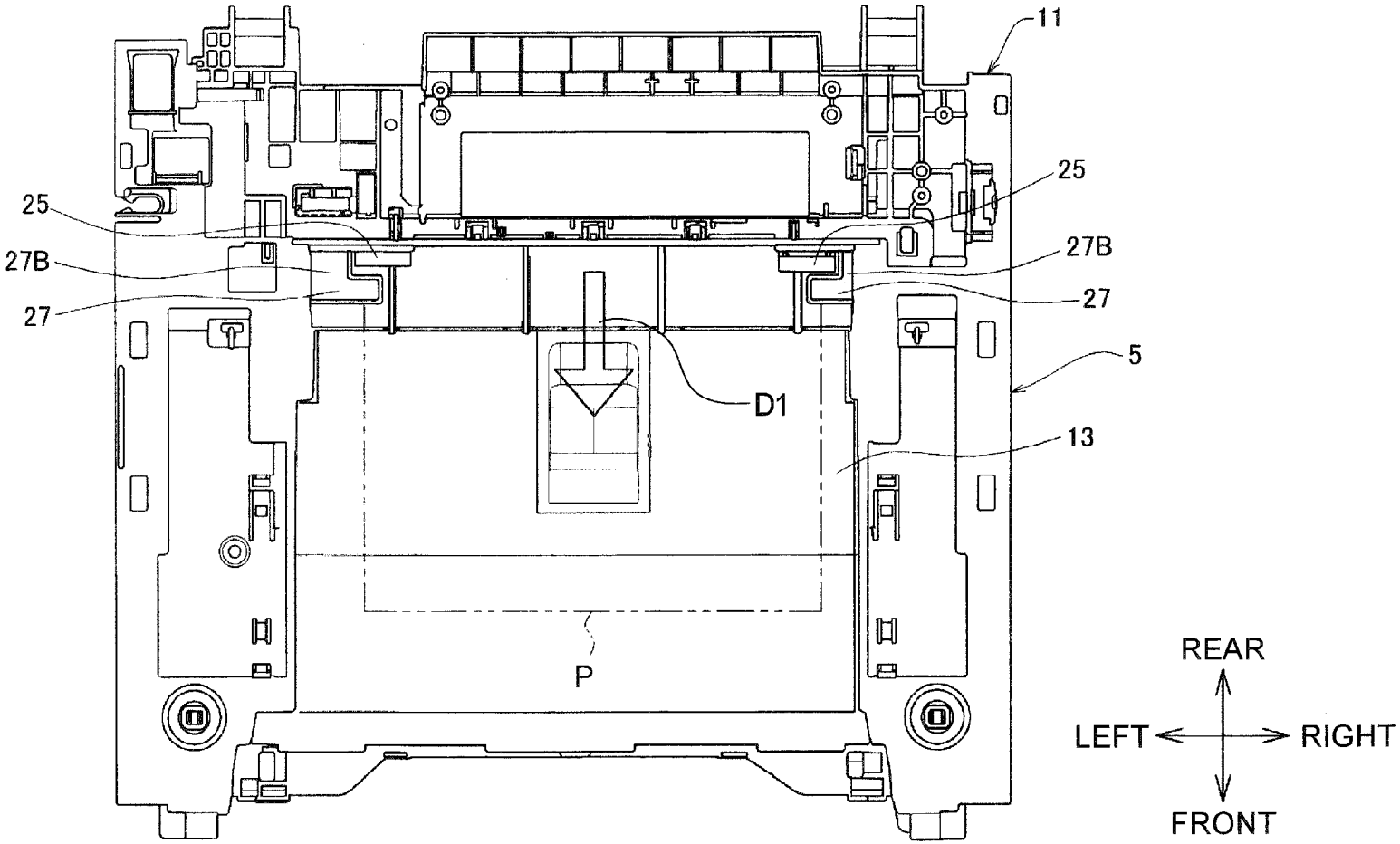
FIG. 4 is a plan view of the image forming mechanism of the image forming apparatus from which the image reading mechanism is removed.

As shown in FIGS. 3 and 4, the stationary sheet guiding members 27 are disposed in positions corresponding to both ends of the ejection portion 20 of the output tray 13 in the width direction or both ends of the ejection roller 21 and the pinch roller 23 in the width direction. Each of the stationary sheet guiding members 27 protrudes substantially horizontally from one wall surface 11A to the other wall surface 11A across the ejection portion 20.

Figure 5:
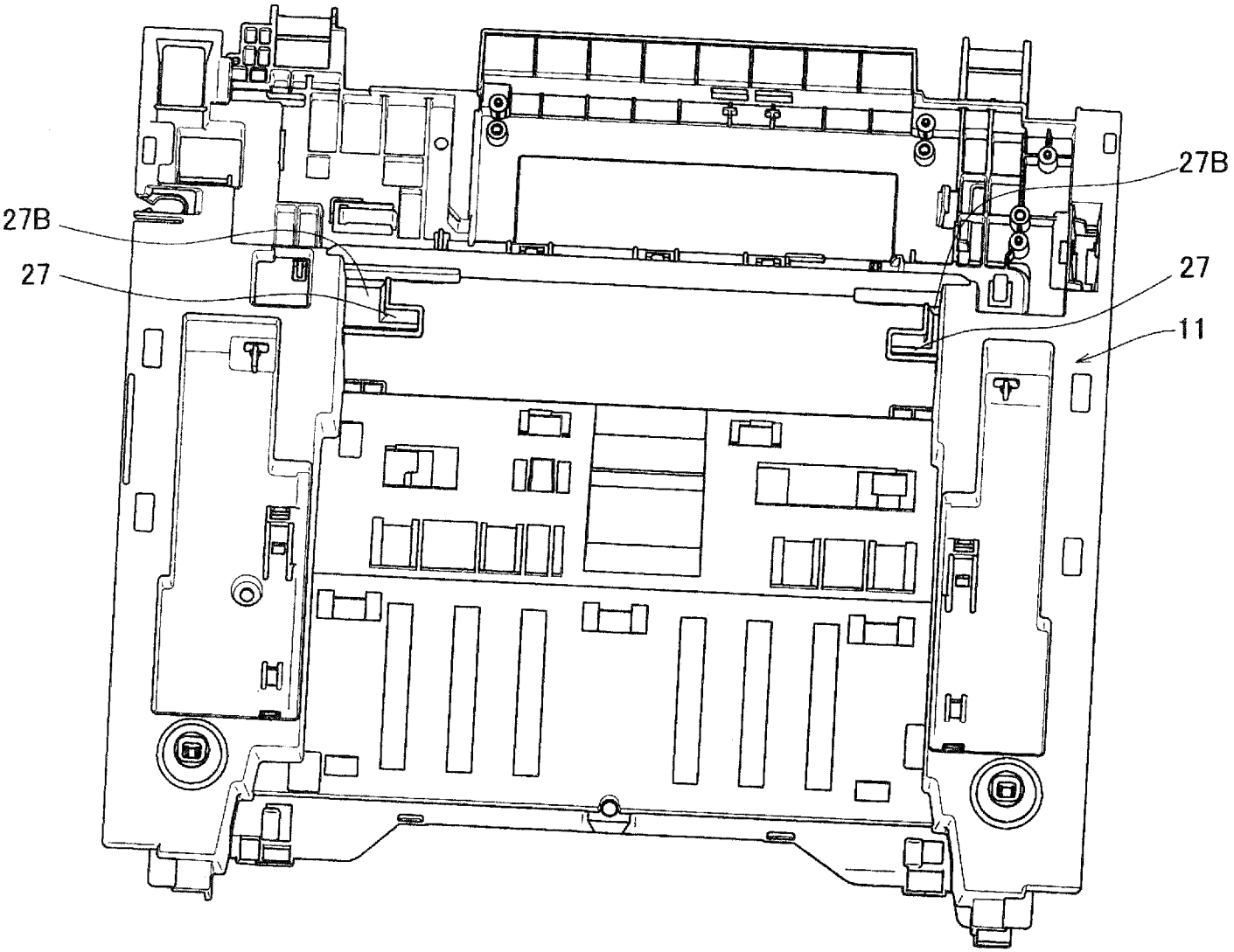
FIG. 5 is a top view of an illustrative joint cover.

As shown in FIG. 5, the output tray 13, the wall surfaces 11A, and the stationary sheet guiding members 27 are integrally formed with the joint cover 11.

As shown in FIG. 7, an end surface of the stationary sheet guiding member 27 facing the ejection portion 20 includes a guide surface 27A which is configured to face a sheet P ejected from the ejection portion 20 toward the output tray 13 (or the sheet receiving portion 13B), that is, downward. The guide surface 27A has an inclined surface inclined in the sheet ejection direction D1 such that the farther the inclined surface extends downward, the farther the inclined surface extends away from the ejection portion 20.

As shown in FIG. 6B, the stationary sheet guiding member 27 is shaped like a letter L and includes an auxiliary sheet guiding member 27B and a protruding portion 27C protruding from the auxiliary sheet guiding member 27B. The auxiliary sheet guiding member 27B is provided to the wall surface 11A, which is connected to a base end of the stationary sheet guiding member 27. The auxiliary sheet guiding member 27B is integrally formed with the joint cover 11, and extends in a direction opposite to the sheet ejection direction D1, or toward the ejection portion 20.

When viewed in a direction parallel to the sheet ejection direction D1, that is, when the ejection portion 20 is viewed in a direction A of FIG. 6B, the movable sheet guiding member 25 and the stationary sheet guiding member 27 overlap each other at least partially and a distal end 27D of the stationary sheet guiding member 27, in a direction where the stationary sheet guiding member 27 protrudes, is located closer to the base end of the stationary sheet guiding member 27 (or the wall surface 11A) than an end of the movable sheet guiding member 25 (a right end 25D in FIG. 6B), which is located on the same side of the distal end of the stationary sheet guiding member 27.

Thus, the movable sheet guiding members 25 are located closer to a central portion in the width direction than the stationary sheet guiding members 27 located on both sides in the width direction (see FIGS. 3 and 4).

As shown in FIG. 8A, the movable sheet guiding member 25 is configured such that a lower end of the movable sheet guiding member 25 when moved to its most upward position is located above a first imaginary line L1 tangent to a lower end of the stationary sheet guiding member 27 and the nip point P1.

Figure 8B:
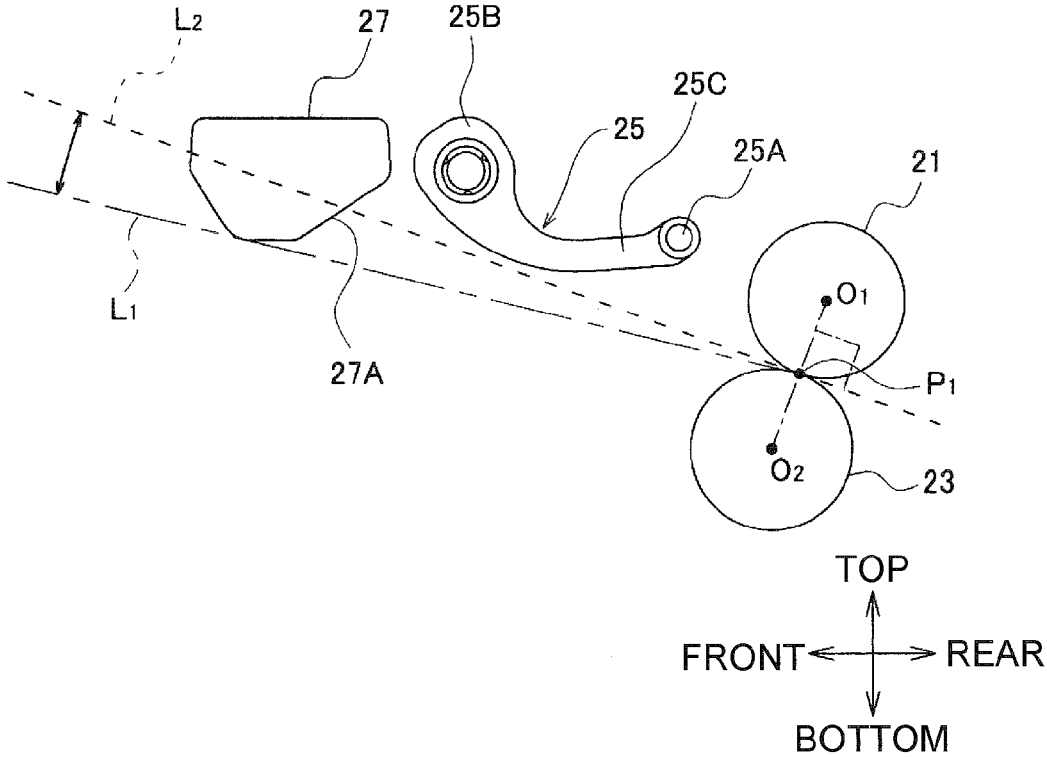

As shown in FIG. 8B, the stationary sheet guiding member 27 is configured such that its lower end is located below a second imaginary line L2, which is orthogonal to a line intersecting the rotation centers O1 and O2 of the ejection roller 21 and the pinch roller 23 and the nip point P1.

In this embodiment, the movable sheet guiding members 25 and the stationary sheet guiding members 27 are provided. For example, when a sheet P having small bending stiffness is ejected, it is fully pressed toward the output tray 13 by the moving sheet guiding members 25, as is conventionally done.

If a sheet P having great bending stiffness gets curled, it may raise the movable sheet guiding members 25 upward. However, the stationary sheet guiding members 27 can press a curled stiff sheet P downward as they protrude from the joint cover 11 constituting a part of the casing 9.

Thus, in this illustrative embodiment, there is no need to increase the weight of the movable sheet guiding members 25 in order to press a curled stiff sheet P downward. Thus, this configuration can stably eject any sheet P, regardless of its bending stiffness.

In this illustrative embodiment, the lower end of the movable sheet guiding member 25 when moved to its most upward position is located below the first imaginary line L1 passing the lower end of the stationary sheet guiding member 27 and the nip point P1.

With this configuration, this illustrative embodiment can prevent a sheet P ejected from the ejection portion 20 from strongly sliding in contact with the movable sheet guiding members 25 when the sheet P contacts the stationary sheet guiding members 27. This can reduce the chance that a resistive force to the sheet P ejected may excessively increase, thereby ejecting the sheet P stably.

In this illustrative embodiment, when viewed in a direction parallel to the sheet ejection direction D1, the movable sheet guiding member 25 and the stationary sheet guiding member 27 overlap each other at least partially.

With this configuration, the movable sheet guiding member 25 and the stationary sheet guiding member 27 can consecutively press a side of a sheet P, in the width direction, ejected from the ejection portion 20. For example, a curled sheet can be pressed downward effectively.

The curled sheet refers to a sheet in which an axial direction of the curl corresponds to the sheet ejection direction D1, that is, a sheet which is curled in the width direction.

In this embodiment, the stationary sheet guiding member 27 is arranged in line with the movable sheet guiding member 25 in the sheet ejection direction D1. When viewed from a user who collects a sheet P ejected to the output tray 13, the stationary sheet guiding members 27 are disposed in front of the movable sheet guiding members 25.

In other words, the movable sheet guiding members 25 are protected by the stationary sheet guiding members 27. When the user collects the ejected sheet P, the potential for the user accidentally touching the movable sheet guiding members 25 can be reduced, and thus the potential damage to the movable sheet guiding members 25 can be avoided.

In this embodiment, as shown in FIG. 6B, the distal end 27D of the stationary sheet guiding member 27 is located closer to the wall surface 11A than the end 25D of the movable sheet guiding member 25.

With this arrangement, this embodiment can reduce the potential that a contact area between the stationary sheet guiding member 27 and a sheet P ejected from the ejection portion 20 will excessively increase. This can reduce the chance that a resistive force to the sheet P ejected will excessively increase, thereby ejecting the sheet P stably.

In this embodiment, the auxiliary sheet guiding member 27B is provided on one side in the width direction, which is on the base end of the stationary sheet guiding member 27. The auxiliary sheet guiding member 27B extends rearward in the sheet ejection direction D1 and is formed integrally with the joint cover 11 constituting a part of the casing 9.

Even when a sheet P ejected from the ejection portion 20 moves toward one side in the width direction, the auxiliary sheet guiding member 27B can press the sheet P downward reliably such that the sheet P can be stably ejected.

In this embodiment, the end surface of the stationary sheet guiding member 27 facing the ejection portion 20 has the guide surface 27A, which is configured to face a sheet P ejected from the ejection portion 20 toward the output tray 13.

In this embodiment, the stationary sheet guiding members 27 are integrally formed with the joint cover 11. The stationary sheet guiding members 27 can be easily formed with the joint cover 11.

If the ejected sheet accommodating space 13A has reached its maximum height, the output tray 13 (or the sheet receiving surface 13B) can be located its maximum distance below the nip point P1. In this case, there is no need to forcibly press a sheet P ejected from the ejection portion 20 downward. In addition, even when the stiff sheet is curled, it does not cause a big problem.

However, it is difficult to increase the height of the ejected sheet accommodating space 13A in the image forming apparatus where the ejected sheet accommodating space 13A for accommodating an ejected sheet P having an image thereon is disposed between the image reading mechanism 7 and the output tray 13. This is because increasing the height of the ejected sheet accommodating space 13A may result in the need to increase the size of the image forming apparatus.

Thus, if the image forming apparatus 1 according to this illustrative embodiment is applied to the image forming apparatus where the ejected sheet accommodating space 13A is disposed between the image reading mechanism 7 and the output tray 13, there is no need to increase the height of the ejected sheet accommodating space 13A and sheets P can be stably ejected.

Figure 9:
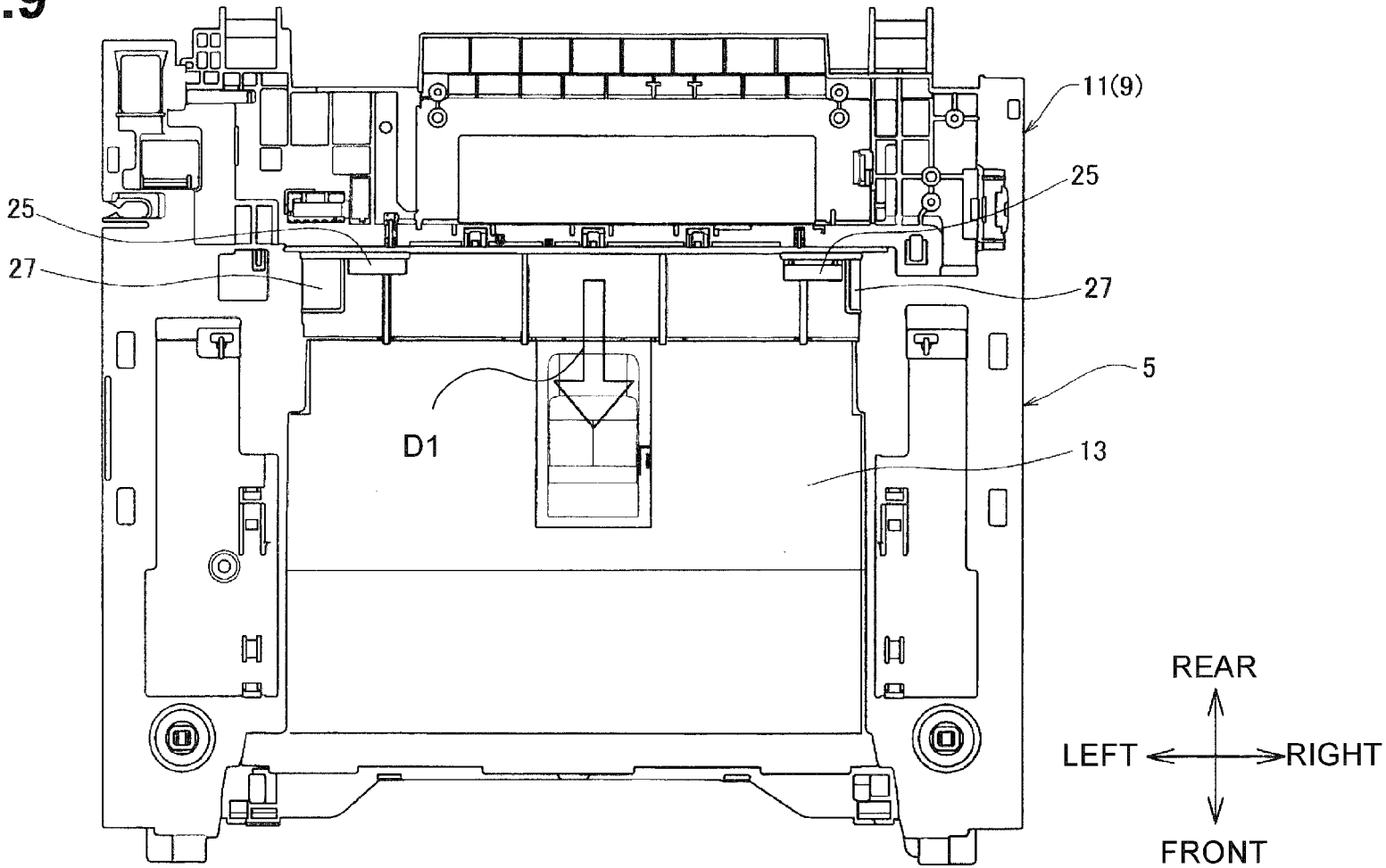
FIG. 9 is a plan view of an illustrative image forming apparatus according to a second embodiment of the invention.

A second illustrative embodiment of the invention will be described with reference to FIG. 9. In the first illustrative embodiment, the stationary sheet guiding members 27 protrude in the width direction. In the second illustrative embodiment, the stationary sheet guiding members 27 protrude from the ejection portion 20 along the sheet ejection direction D1.

In the second illustrative embodiment, the stationary sheet guiding members 27 are integrally formed with the joint cover 11. The stationary sheet guiding members 27 and the joint cover 11 may be manufactured individually and then coupled together.

The above illustrative embodiments show, but are not limited to, a monochrome laser printer and an image reading mechanism being combined into one. Instead of the monochrome laser printer, a color laser printer and an inkjet printer may be applicable.

The above illustrative embodiments show, but are not limited to, that the stationary sheet guiding member 27 having the guide surface 27A is hexagonal in cross section. The stationary sheet guiding member 27 may be cylindrical.

The above illustrative embodiments show, but are not limited to, that the movable sheet guiding members 25 and the stationary sheet guiding members 27 are provided on both sides in the width direction. One stationary sheet guiding member 27 may be provided on one end in the width direction and one movable sheet guiding member 25 may be provided on the other end in the width direction. Alternatively, the stationary sheet guiding member 27 and the movable sheet guiding member 25 may be provided on one end in the width direction.

The above illustrative embodiments show, but are not limited to, that the ejection roller 21 and the pinch roller 23 together functioning as an ejection device. For example, belts may be used as the ejection device.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a main body;

an image forming unit disposed in the main body and configured to form an image on a recording medium;

an output tray provided in an upper portion of the main body and configured to receive the recording medium having an image formed thereon, said output tray having a lower surface on which the recording medium lays and side surfaces extending upward from the lower surface;

an ejection device provided in the main body and configured to eject the recording medium to the output tray;

a movable sheet guiding member movably attached to the main body, the movable sheet guiding member being configured to press the recording medium ejected from the ejection device downward; and a stationary sheet guiding member disposed downstream of the movable sheet guiding member in a recording medium ejection direction where the recording medium is to be ejected from the ejection device, the stationary sheet guiding member being disposed above the output tray and in a position corresponding to a first side of the output tray in a width direction perpendicular to both the recording medium ejection direction and a thickness direction of the recording medium to be ejected to the output tray, the stationary sheet guiding member protruding from a first of the side surfaces of the output tray, wherein the stationary sheet guiding member is configured to guide the recording medium downward toward the output tray, whereupon the movable sheet guiding member is in an upward position.

2. The image forming apparatus according to claim 1, wherein the stationary sheet guiding member protrudes from the first of the side surfaces of the output tray in the width direction.

3. The image forming apparatus according to claim 1, wherein the movable sheet guiding member is configured to have a lower end that when moved to its most upward position is located above a first imaginary line, which is tangent to a lower end of the stationary sheet guiding member and a contact point where the ejection device contacts the recording medium.

4. The image forming apparatus according to claim 1, wherein the ejection device includes first and second rollers, and wherein the stationary sheet guiding member is configured to have a lower end located below a second imaginary line, which is orthogonal to a line that intersects rotation centers of the first and second rollers and a contact point between the first and second rollers.

5. The image forming apparatus according to claim 1, wherein, when viewed in a direction parallel to the recording medium ejection direction, the movable sheet guiding member and the stationary sheet guiding member overlap each other at least partially.

6. The image forming apparatus according to claim 5, wherein an end of the stationary sheet guiding member closest to a second side of the output tray in the width direction, which is opposite to the first side, is located closer to the first side of the output tray than an end of the movable sheet guiding member closest to the second side of the output tray.

7. The image forming apparatus according to claim 1, wherein the stationary sheet guiding member includes an auxiliary sheet guiding member extending in a direction opposite the recording medium ejection direction.

8. The image forming apparatus according to claim 1, wherein the stationary sheet guiding member includes an end surface facing the ejection device, and the end surface includes a guide surface configured to face a recording medium ejected from the ejection device toward the output tray.

9. The image forming apparatus according to claim 1, further comprising a second stationary sheet guiding member disposed in a position corresponding to a second side of the output tray in the width direction, which is opposite to the first side, the second stationary sheet guiding member protruding from the main body, wherein the stationary sheet guiding member and the second stationary sheet guiding member are integrally formed with an upper cover of a second of the side surfaces of the output tray.

10. The image forming apparatus according to claim 1, further comprising an image reading mechanism disposed to cover an upper portion of the output tray, wherein a space is provided between the image reading mechanism and the output tray and the ejection portion is configured to eject the recording medium into the space.

11. The image forming apparatus according to claim 1, wherein the movable sheet guiding member includes a shaft located above a contact point where the ejection device is configured to contact the recording medium, and the movable sheet guiding member is configured to pivot on the shaft.

12. The image forming apparatus according to claim 1, wherein the stationary sheet guiding member protrudes from the first of the side surfaces along the recording medium ejection direction.

13. The image forming apparatus according to claim 1, wherein the stationary sheet guiding member has an inclined guide surface inclined with respect to the recording medium ejection direction such that the farther the inclined guide surface extends downward, the farther the inclined guide surface extends away from the ejection device.

14. The image forming apparatus according to claim 1, wherein the stationary sheet guiding member is polygonal in cross section and has an inclined guide surface facing the ejection device, and the inclined guide surface extends downward.

15. The image forming apparatus according to claim 1, wherein, when the movable sheet guiding member presses the recording medium ejected from the ejection device downward, the stationary sheet guiding member does not guide the recording medium downward to the output tray.

* * * * *